US011332877B1

(12) United States Patent
Dighton

(10) Patent No.: US 11,332,877 B1
(45) Date of Patent: May 17, 2022

(54) COLD-AIR DRYER

(71) Applicant: Haskell M. Dighton, Corsicana, TX (US)

(72) Inventor: Haskell M. Dighton, Corsicana, TX (US)

( * ) Notice: Subject to any disclaimer, the term of this patent is extended or adjusted under 35 U.S.C. 154(b) by 149 days.

(21) Appl. No.: 16/734,274

(22) Filed: Jan. 3, 2020

Related U.S. Application Data

(60) Provisional application No. 62/787,999, filed on Jan. 3, 2019.

(51) Int. Cl.

| | |
|---|---|
| ***D06F 58/24*** | (2006.01) |
| ***F28D 21/00*** | (2006.01) |
| ***D06F 58/22*** | (2006.01) |
| ***D06F 58/04*** | (2006.01) |
| ***D06F 58/10*** | (2006.01) |

(52) U.S. Cl.
CPC ..... *D06F 58/24* (2013.01); *D06F 58/04* (2013.01); *D06F 58/10* (2013.01); *D06F 58/22* (2013.01); *F28D 21/0012* (2013.01); *F28D 2021/0061* (2013.01)

(58) Field of Classification Search
CPC ..... D06F 58/04; D06F 58/10; D06F 58/22; D06F 58/24; D06F 58/20; F28D 21/0012; F28D 21/0061
See application file for complete search history.

(56) References Cited

U.S. PATENT DOCUMENTS

| | | | | |
|---|---|---|---|---|
| 2,495,535 | A | 1/1950 | Morrison | |
| 7,458,171 | B1 * | 12/2008 | Lentz | D06F 58/20 34/75 |
| 2005/0205483 | A1 | 9/2005 | Kim | |
| 2006/0254082 | A1 | 11/2006 | Kim | |
| 2010/0058608 | A1 * | 3/2010 | Moon | D06F 58/10 34/282 |

FOREIGN PATENT DOCUMENTS

| | | |
|---|---|---|
| JP | H0857194 | 3/1996 |
| KR | 20060083424 A | 7/2006 |

* cited by examiner

*Primary Examiner* — Edelmira Bosques
*Assistant Examiner* — Bao D Nguyen
(74) *Attorney, Agent, or Firm* — Derrick Harvey; Harvey Law, PC

(57) ABSTRACT

The present invention relates drying clothes and other fabrics. The present invention further relates to a cold-air system for removing moisture from fabric. The present invention even further relates to a system for drying fabrics in a closed, non-exhausted system. The present invention even further relates to a free-standing, low energy appliance for drying fabrics.

17 Claims, 4 Drawing Sheets

COLD-AIR DRYER

RELATED APPLICATIONS

This application claims priority from U.S. Provisional Application No. 62/787,999 filed on Jan. 3, 2019 and entitled "Cold-Air Dryer", the entire contents of which are hereby fully incorporated herein.

BACKGROUND OF THE INVENTION

1. Field of the Invention

The present invention relates drying clothes and other fabrics. The present invention further relates to a cold-air system for removing moisture from fabric. The present invention even further relates to a system for drying fabrics in a closed, non-exhausted system. The present invention even further relates to a free-standing, low energy appliance for drying fabrics.

2. Description of Related Art

The practice of drying clothes has evolved throughout time, but has typically focused upon using moving air or heat to remove moisture. Both approaches have the capacity to dry fabrics, but require great amounts of time and/or energy to accomplish removing an effective amount of moisture. Furthermore, conventional fabric dryers require a vent to remove the moisture-rich air from the dryer and 220V AC power outlets.

Thus, a need exists for a fabric drying solution that is faster, uses less energy without sacrificing performance. Furthermore, a need exists for a dryer that does not need venting so it may be used in spaces that have no exterior access. A need further exists to dry clothes in a manner that damages fabrics less.

SUMMARY OF THE INVENTION

These and other objects were met with the present invention. The present system accomplishes energy savings and easy deployment by using 110 v outlet rather than 220 v as with environment or space by obviating the need for venting. The present invention accomplishes the objective of reducing the cycle time of drying fabrics, thereby solving the issues of premature wear and destruction of fabric and high energy costs associated with heated units.

The present invention relates in a first embodiment to a method of removing moisture from fabrics, comprising:

A method of removing moisture from fabrics, comprising:

(a) placing fabrics in a drum cavity of a dryer;

(b) circulating coolant through a closed coolant loop of a dryer having a heat exchanger, (c) circulating air through a closed air loop, the closed air loop including through the drum cavity of the dryer containing wet fabrics that produces moist air, the closed air loop further comprising a filtering mechanism, and further circulating the moist air passing through the heat exchanger to remove heat and thus moisture from the moist air that passes into the dryer drum; and (d) Separating water produced from the heat exchanger from the coolant loop and the air loop; whereas the step of circulating coolant through a closed coolant loop of a dryer having a heat exchanger; whereas the heat exchanger communicates with the closed coolant loop; whereas the step of placing fabrics in a drum cavity including rotating the drum cavity in an axial manner; the method further comprising powering the dryer with an 110V plug; whereas the step of circulating air through a closed air loop obviates the need to exhaust air outside of the dryer; the method further comprising collecting the water in a reservoir; the reservoir further comprising an evaporating mechanism; the method further comprising draining the water outside of the dryer.

The present invention relates to a second embodiment for a system for drying fabrics, the system comprising A system for drying wet fabrics, the system comprising:

An air loop extending through a fabric drying drum and a heat exchanger capable of carrying air that cools and dries at the heat exchanger;

An coolant loop spanning a heat exchanger and a compressor, the compressor capable of pressurizing and cooling a coolant in the coolant line to apply at the heat exchanger, A water drain to remove water after leaving the fabric drying drum, the water drain removing water from the air at the heat exchanger, and A power coupling element to power the system; the air loop further comprising a filtering mechanism to catch lint from the fabric, the filtering mechanism being disposed after the drying drum and being accessible by a user of the system; the system being optimized as a dryer for low-power consumer use, whereas the power coupling is 110V; the system being optimized as a dryer for unvented spaces, whereas the air loop is closed and requires no exhaust ventilation; the water drain communicating water to a water reservoir for storage; the water drain communicating water to an evaporating element; the heat exchanger comprising a mechanism for conveying the cooled and drier air into the drying drum; the drying drum capable of rotating axially to provide a tumbling effect upon the fabrics.

BRIEF DESCRIPTION OF THE DRAWINGS

The invention will now be described in greater detail with reference to the drawings, wherein.

DETAILED DESCRIPTION OF THE INVENTION

The present invention provides a solution to lowering high electric bills. The present invention provides a faster drying time for clothes and fabric. The present invention provides a further solution that obviates a need for venting for a dryer.

While the present invention has been described in conjunction with the specific embodiments set forth above, many alternatives, modifications and other variations thereof will be apparent to those of ordinary skill in the art. All such alternatives, modifications and variations are intended to fall within the spirit and scope of the present invention.

Figure 1:
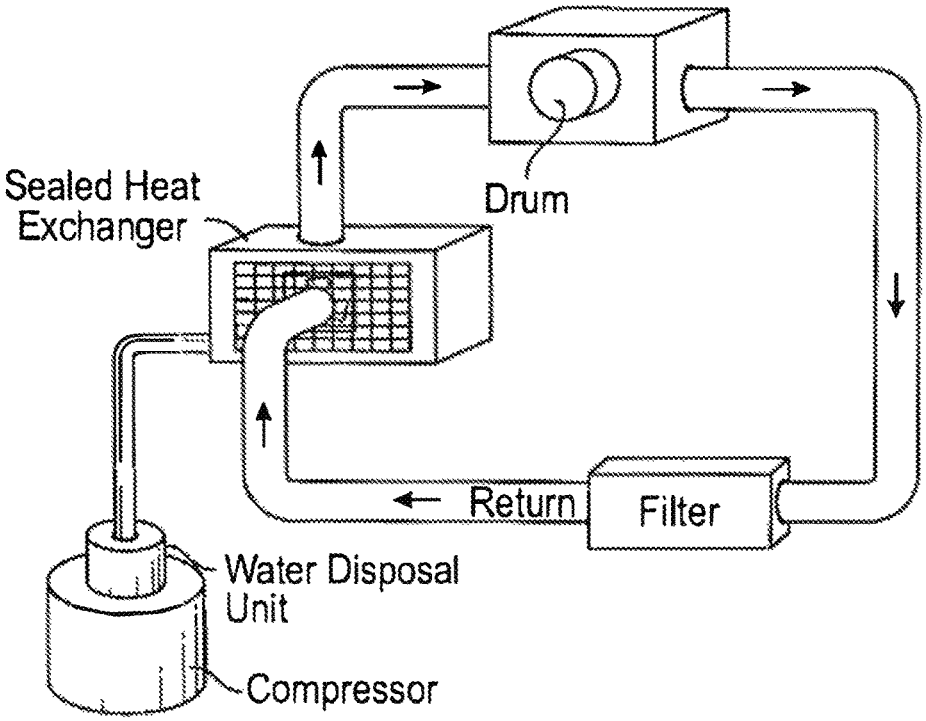
FIG. 1 is a side plan view of an embodiment of a closed drying appliance having a sealed heat exchanger.
Figure 2:
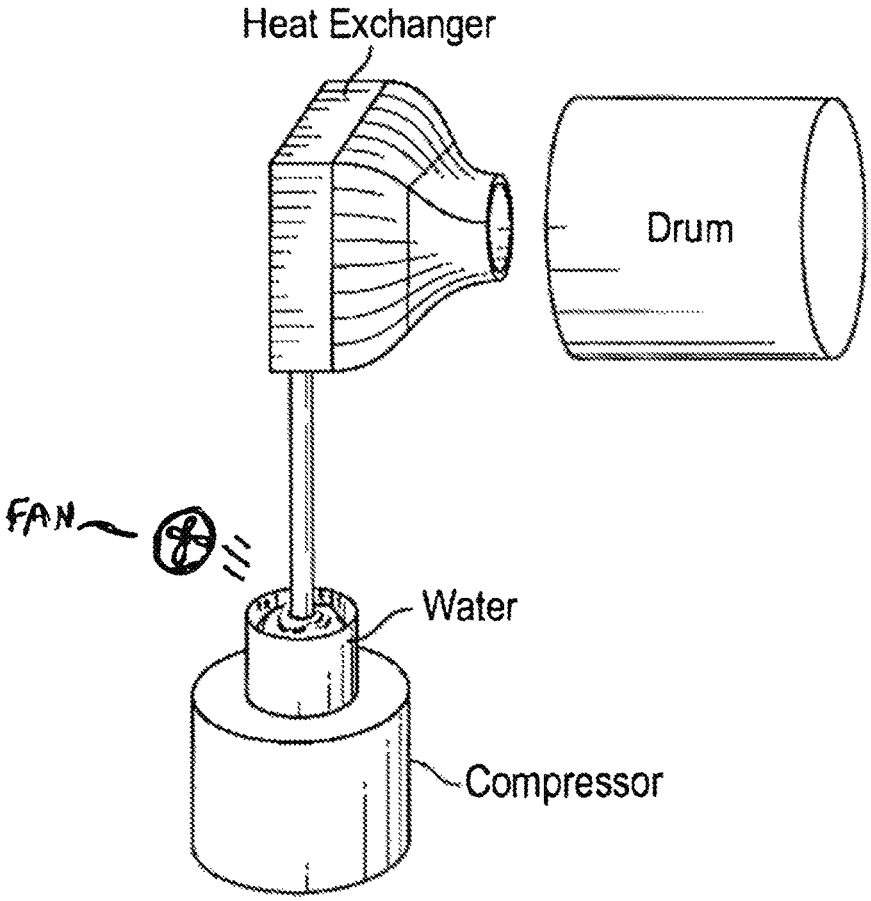
FIG. 2 is a side view of the heat exchanger portion of the system as it communicates with a drying drum and a compressor.

In FIG. 1, a plan schematic is depicted for an embodiment of the inventive system. An air loop may connect the drying drum, a filter and a heat exchanger portion of the air loop. The air loop may be closed so that outside exhaust venting is unnecessary. In an embodiment of the invention, the air may pass through the drying drum where some ambient air exchange is possible. In the drying drum, the air may gain moisture from the wet fabrics. In embodiments of the invention, the dryer drum may have an axial rotation as is known in the arts of clothes dryers to expose the fabrics to the air so that the moisture exchange may be optimized. After the air loop leaves the drying drum with the moist air, it may pass through a filtering mechanism where lint and other fabric particles may be removed. The air loop may then comprise a heat exchange portion, where the air is super-cooled and moisture is via the water line as seen in FIG. 2. The heat exchange portion may be positioned as illustrated in FIG. 2, or may be placed along other aspects of the air loop in other embodiments of the invention.

Figure 3:
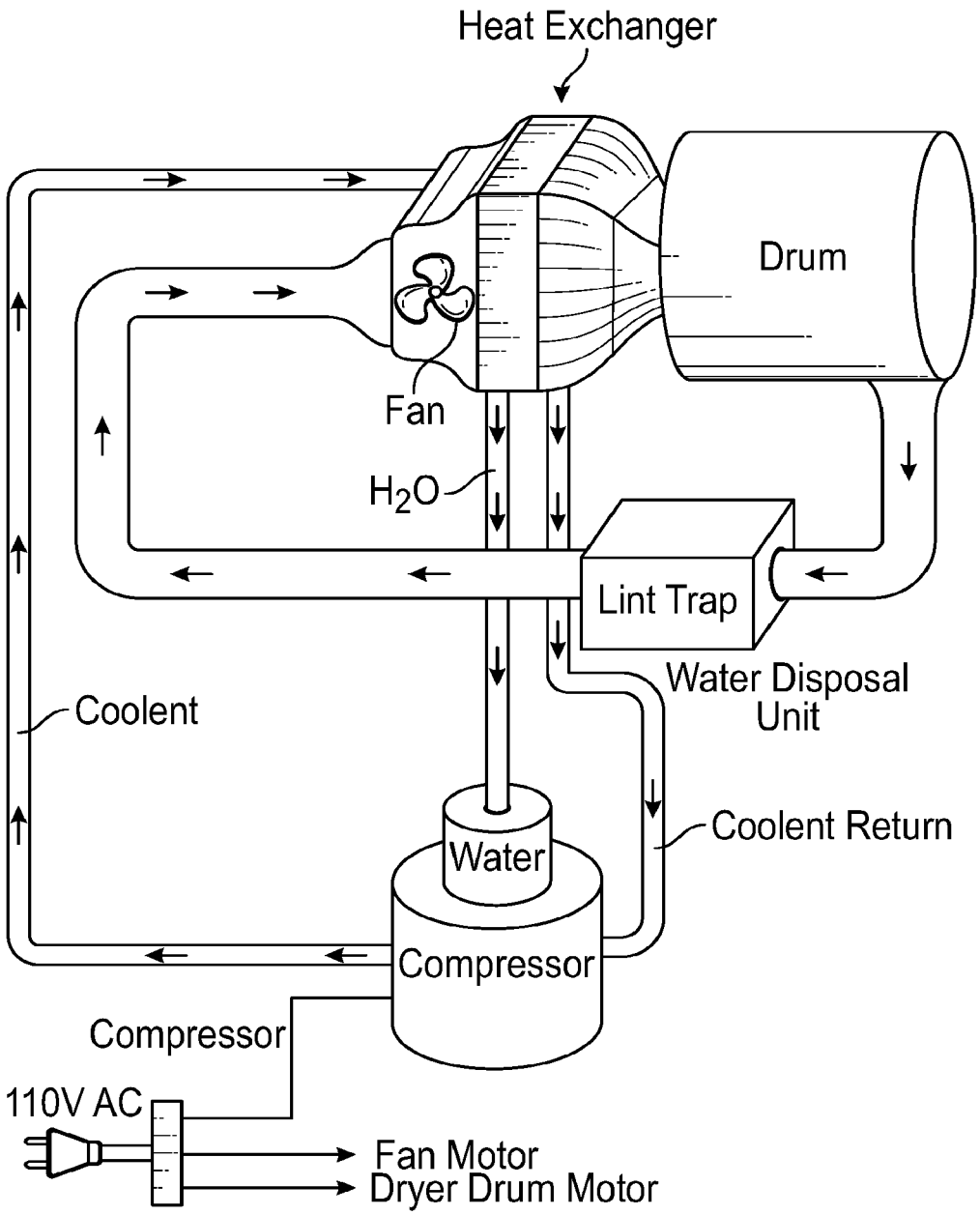
FIG. 3 is a diagram of an embodiment of a closed drying appliance in detail.
Figure 5:
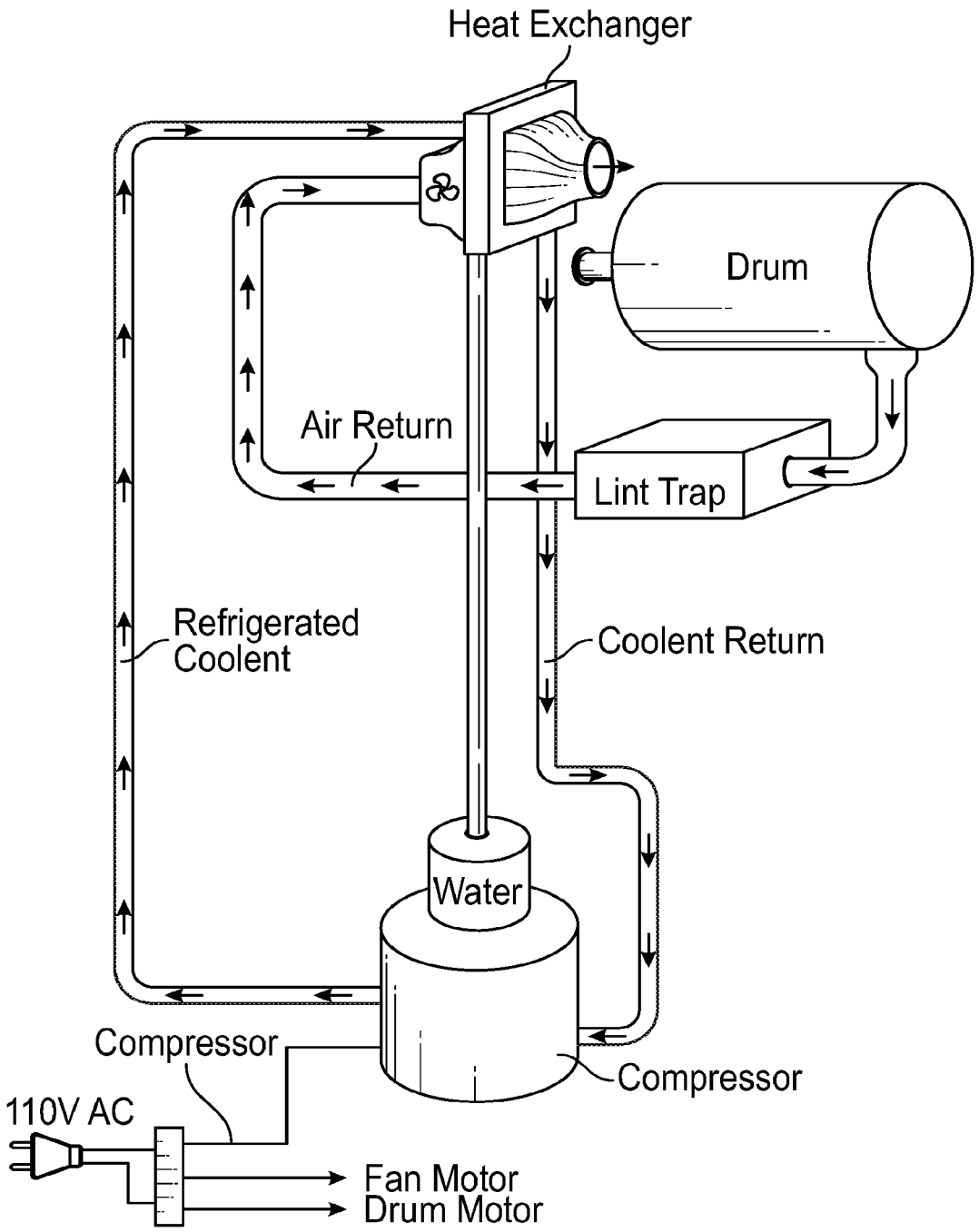
FIG. 5 is a diagram of an embodiment of a closed drying appliance in detail.

As seen in FIGS. 3 and 5, a refrigerant loop may comprise a closed loop from compressor to the heat exchanger and may further comprise a pressurized liquid or other refrigerant. Liquid may be variations of coolants known commercially traditionally as Freon, r243 or other coolants known in the arts. The refrigerant line may continue cycling through heat exchanger, super-cooling the coils while the coolant gains heat and enters into a higher volume chamber, the refrigerant loses pressure because of volume change from the line to the heat exchanger. In other embodiments and within the closed loop, additional and/or equivalent structures may be positioned to accomplish additional and/or equivalent functionalities.

In embodiments of the invention seen in FIGS. 1, 3 and 5, a water line may be deployed between the water reservoir and the heat exchanger. Water may be generated via condensation from coils of the heat exchangers as the return air cycles through the heat exchanger. The water disposal unit may have an overflow reservoir that may be emptied at the time the lint trap or remover would be emptied. The water reservoir may be interlocked with the power on activator or system operational switch so that the water reservoir must be emptied before continued usage (and preventing water overflow). Water reservoir may comprise additional storage capabilities according to embodiments of the invention. For example, water reservoir may include a raised perimeter that allows a volume of liquid to accumulate without overflowing, or may include separate containers connected by overflow lines separate from the water reservoir as depicted in the illustrations. In other embodiments water may be disposed through other methods and structures within the scope of this invention. For example, water lines may transport the water directly or indirectly away to a drain, exterior space, or other disposal technique such as evaporation system. The evaporation system may comprise a small fan or other evaporation aid that enables the water collected to evaporate into the surrounding air.

Figure 4:
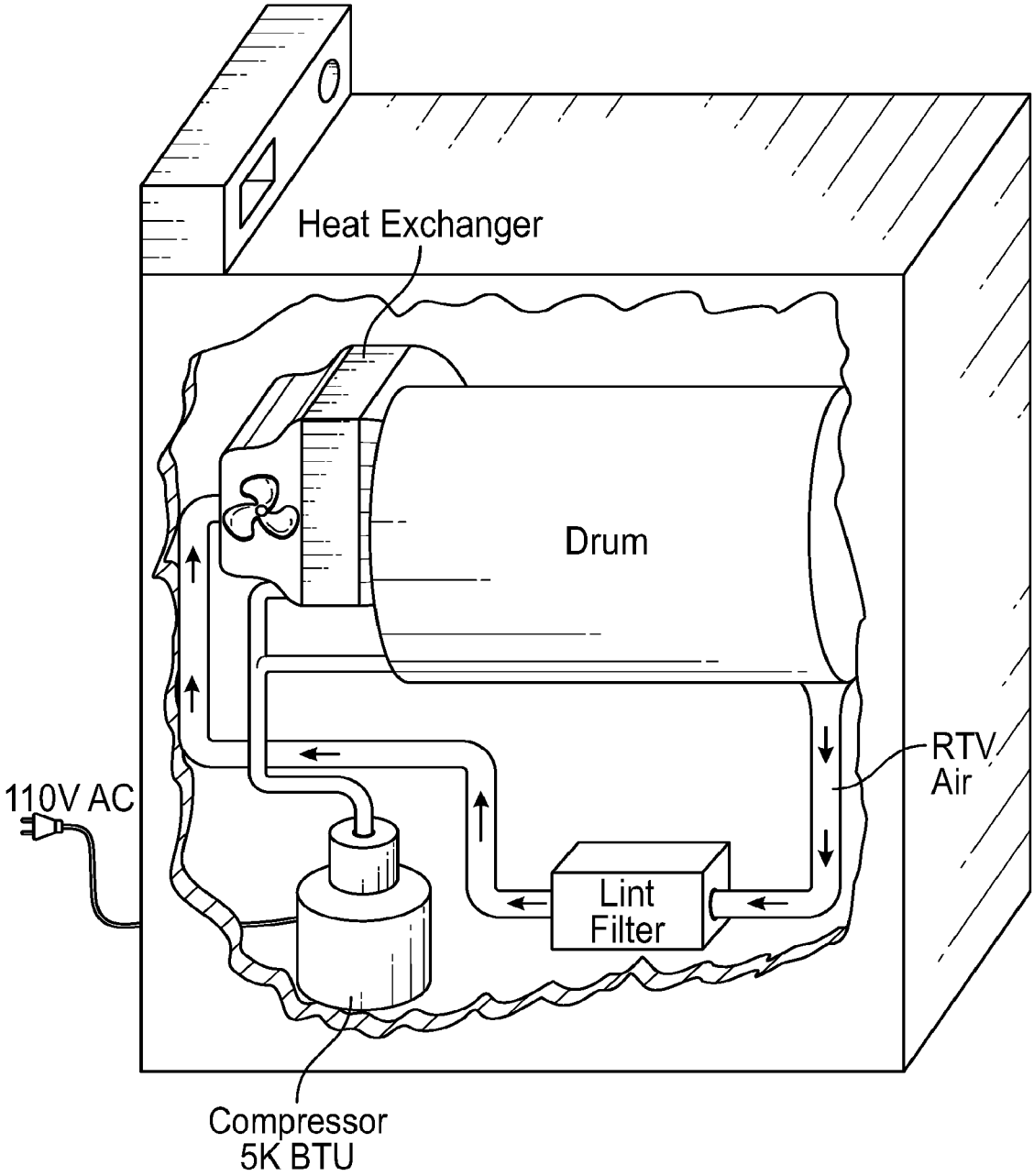
FIG. 4 is a side view of a drying appliance with the side wall removed to reveal internal operating components.

FIG. 4 illustrates an embodiment of the inventive fabric cooling system as installed in a consumer clothes dryer frame that plugs into an 110V ac outlet, which may power a compressor to help remove water from the cooled air, a fan motor working with the heat exchanger, a dryer motor to turn the dryer drum, and other components of the dryer as needed. The compressor may be any compressor known in the arts as used in clothes driers, including a 5K BTU compressor. An air loop may extend between the drum, a lint remover, and the heat exchanger. In other embodiments and within the closed loop, additional and/or equivalent structures may be positioned to accomplish additional and/or equivalent functionalities. The dryer from FIG. 4 may include a coolant loop as seen in FIG. 5 and that may cool the air at the heat exchanger.

The present disclosure has been described with reference to various embodiments. However, one of ordinary skill in the art appreciates that various modifications and changes can be made without departing from the scope of the present disclosure. Accordingly, the specification is to be regarded in an illustrative rather than a restrictive sense, and all such modifications are intended to be included within the scope of the present disclosure. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element of any or all the claims.

The invention claimed is:

1. A method of removing moisture from fabrics, comprising:

(a) placing fabrics in a drum cavity of a dryer;

(b) circulating coolant through a closed coolant loop of the dryer, the dryer further having a heat exchanger, (c) circulating cold air through a closed air loop and through the drum cavity of the dryer containing wet fabrics, producing moist air in the closed air loop, the closed air loop further circulating the moist air passing through the heat exchanger to remove heat and moisture from the moist air to create the cold air; and (d) separating water produced from the heat exchanger from the closed coolant loop and the closed air loop.

2. The method of claim 1, the step of circulating coolant through the closed coolant loop of the dryer having the heat exchanger; whereas the heat exchanger communicates with the closed coolant loop.

3. The method of claim 1, the step of placing fabrics in the drum cavity including rotating the drum cavity in an axial manner.

4. The method of claim 1 further comprising:

Powering the dryer with an 110V plug.

5. The method of claim 1, whereas the step of circulating air through the closed air loop obviates a need to exhaust air outside of the dryer.

6. The method of claim 1 further comprising:

Collecting the water in a reservoir.

7. The method of claim 1 further comprising disposing of the water using an evaporating mechanism.

8. The method of claim 1 further comprising:

Draining the water outside of the dryer.

9. The method of claim 1, the closed air loop further comprising a filtering mechanism.

10. A system for drying wet fabrics, the system comprising:

an air loop extending through a fabric drying drum and a heat exchanger, the heat exchanger capable of removing heat and water in the air loop to create cold air, whereas the air loop carries the cold air into the fabric dryer drum;

a coolant loop spanning the heat exchanger and a compressor, the compressor capable of pressurizing and cooling a coolant in the coolant loop to apply at the heat exchanger, a water drain to remove the water after leaving the fabric drying drum, the water drain removing water at the heat exchanger, and a power coupling element to power the system.

11. The system in claim 10, the air loop further comprising a filtering mechanism to catch lint from the fabric, the filtering mechanism being disposed after the fabric drying drum and being accessible by a user of the system.

12. The system in claim 10 optimized as a dryer for low-power consumer use, whereas the power coupling element is 110V.

13. The system in claim 10 optimized as a dryer for unvented spaces, whereas the air loop is closed and requires no exhaust ventilation.

14. The system in claim 10, the water drain communicating water to a water reservoir for storage.

15. The system in claim 10, water drain communicating water to an evaporating element.

16. The system in claim 10, the heat exchanger comprising a mechanism for conveying the cooled and drier air into the drying drum.

17. The system in claim 10, the drying drum capable of rotating axially to provide a tumbling effect upon the fabrics.

* * * * *